US006585048B1

(12) United States Patent
Heijnen

(10) Patent No.: US 6,585,048 B1
(45) Date of Patent: Jul. 1, 2003

(54) WELLBORE SYSTEM HAVING NON-RETURN VALVE

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/711,013

(22) Filed: Nov. 9, 2000

(51) Int. Cl.[7] ..... E21B 34/06; E21B 34/08

(52) U.S. Cl. ..... 166/325; 166/321; 166/386; 175/243

(58) Field of Search ..... 166/383, 386, 166/320, 374, 154, 321, 156, 319, 325; 137/493, 493.2, 493.3, 493.9, 496, 515, 535, 540; 175/232, 243

(56) References Cited

U.S. PATENT DOCUMENTS

| | | | | | |
|---|---|---|---|---|---|
| 3,603,394 | A | * | 9/1971 | Raulins | 137/460 |
| 3,974,876 | A | * | 8/1976 | Taylor | 137/504 |
| 4,257,484 | A | * | 3/1981 | Whitley et al. | 137/115.26 |
| 4,576,196 | A | * | 3/1986 | Ross et al. | 166/318 |
| 4,625,755 | A | * | 12/1986 | Reddoch | 137/327 |
| 4,749,044 | A | * | 6/1988 | Skipper et al. | 166/301 |
| 5,293,905 | A | | 3/1994 | Friedrich | |
| 5,465,787 | A | * | 11/1995 | Roth | 166/319 |
| 5,655,607 | A | | 8/1997 | Mellemstrand et al. | |
| 5,680,902 | A | * | 10/1997 | Giroux et al. | 166/321 |
| 5,690,177 | A | * | 11/1997 | Budde | 166/321 |
| 5,947,206 | A | * | 9/1999 | McCalvin et al. | 166/321 |
| 5,957,207 | A | * | 9/1999 | Schnatzmeyer | 166/320 |
| 5,992,524 | A | * | 11/1999 | Graham | 166/117.6 |
| 6,152,224 | A | * | 11/2000 | French | 166/130 |
| 6,283,217 | B1 | * | 9/2001 | Deaton | 166/324 |
| 6,349,771 | B1 | * | 2/2002 | Luke | 166/386 |

OTHER PUBLICATIONS

International Search Report dated Feb. 13, 2001.

* cited by examiner

*Primary Examiner*—David Bagnell
*Assistant Examiner*—Jennifer H Gay

(57) ABSTRACT

In a wellbore system, non-return valves placed in one or more well boreholes within the system. The valves are placed in the production string downstream from the producing zones, the valve having a closure member selectively biased to a closed position against flow from the producing zones. A fluid backpressure in the production string further operates to bias the valve to the dosed position. When the fluid backpressure is reduced, the force exerted by the flow from the producing zone against the closure member is sufficient to move the closure member in its open position. The closure member is maintained in its open position as a result of the force exerted by the flow from the production zone. An increase in fluid backpressure on the valve results in the movement of the closure member from the open position to the closed position.

6 Claims, 2 Drawing Sheets

WELLBORE SYSTEM HAVING NON-RETURN VALVE

CROSS-REFERENCE TO RELATED APPLICATIONS

Not Applicable

STATED REGARDING FEDERALLY SPONSORED RESEARCH OR DEVELOPMENT

Not Applicable

BACKGROUND OF THE INVENTION

Field of the Invention

The present invention relates to a wellbore system comprising a borehole formed in the earth formation, the borehole being provided with a valve having a passage for a stream of fluid flowing from an upstream side of the valve to a downstream side of the valve. In the practice of production of hydrocarbon fluid from a wellbore valves are generally applied to control the flow rate of the produced fluid or to shut off the wellbore in case of an emergency. Such valves generally allow flow of fluid through the borehole in both directions thereof.

It is an object of the invention to provide a wellbore system comprising a borehole formed in the earth formation, the borehole being provided with a valve allowing flow of fluid in one direction through the borehole and preventing flow of fluid in the other direction through the borehole.

BRIEF SUMMARY OF THE INVENTION

In accordance with the invention there is provided a wellbore system comprising a borehole formed in the earth formation, the borehole being provided with a valve having a passage for a stream of fluid flowing from an upstream side of the valve to a downstream side of the valve, a closure member exposed to a drag force exerted by the stream and movable relative to the passage between an open position in which the closure member allows fluid to flow through the passage and a closed position in which the closure member closes the passage, said drag force biasing the closure member to the open position thereof, and a spring exerting a spring force to the closure member biasing the closure member to the closed position, wherein the spring force when the closure member is in the closed position exceeds a selected lower limit of the drag force.

Suitably the valve is oriented in the borehole in a manner that the closure member is biased to the open position thereof by the drag force exerted by the stream pumped through the borehole in downward direction thereof.

Preferably the valve is oriented in the borehole in a manner that the closure member is biased to the open position thereof by the drag force exerted by the stream flowing through the borehole in upward direction thereof.

BRIEF DESCRIPTION OF THE DRAWINGS

The invention will be described further in more detail and with reference to the accompanying drawing in which FIG. 1 schematically shows a wellbore system according to the invention formed in an earth formation.

DETAILED DESCRIPTION OF THE PREFERRED EMBODIMENT

Figure 1:
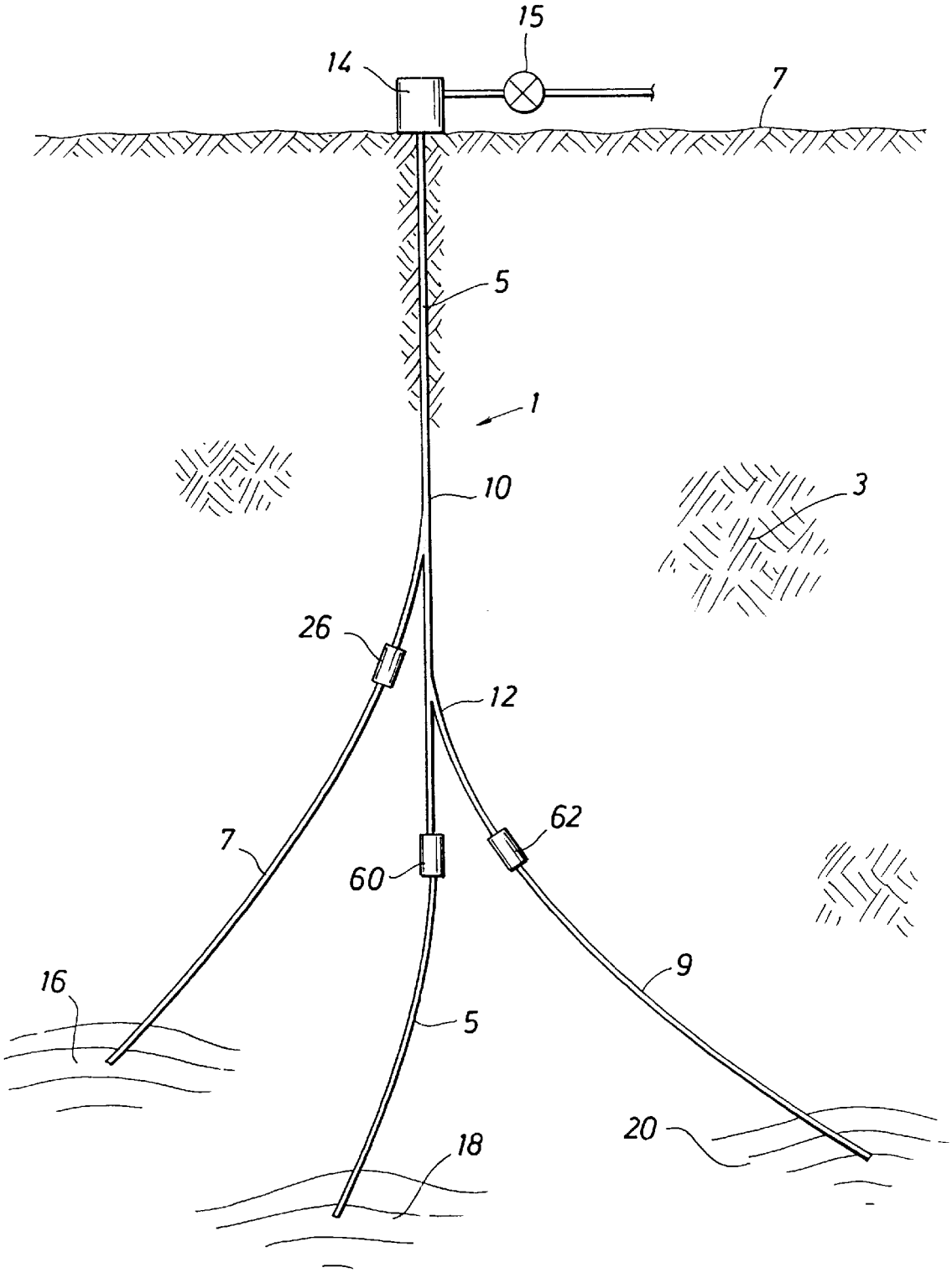

Referring to FIG. 1 there is shown a wellbore system 1 formed in an earth formation 3, the wellbore system including a main borehole 5 and two branch boreholes 7, 9 extending from the main borehole 5 into the earth formation 3 at respective borehole junctions 10, 12. The main borehole 5 is at its upper end in fluid communication with a hydrocarbon gas production facility 14 provided with a production control valve 15 arranged at surface. The boreholes 5, 7, 9 extend into respective hydrocarbon gas reservoirs 16, 18, 20 of mutually different gas pressures, whereby the gas pressure $P_1$, in reservoir 20 is higher than the gas pressure $P_2$ in reservoir 18, and the gas pressure $P_2$ in reservoir 18 is higher than the gas pressure $P_3$ in reservoir 16. Each branch borehole 7, 9 and the main borehole 5 are provided with a respective wellbore casing (not shown), whereby the casings of the branch boreholes 7, 9 are connected to the casing of the main borehole at the respective wellbore junctions 10, 12 in a sealing manner.

Figure 2:
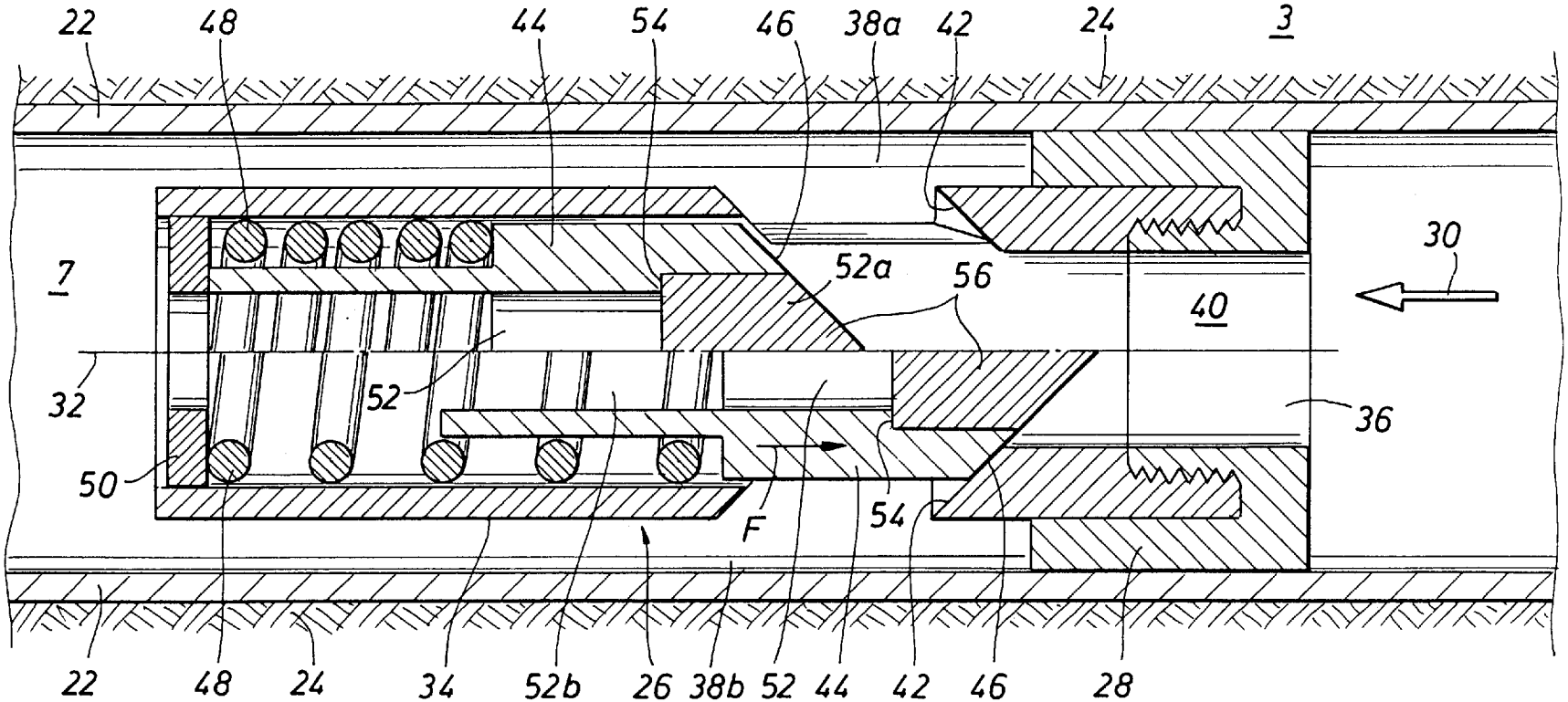
FIG. 2 schematically shows an embodiment of the valve applied in the wellbore system according to the invention.

Referring further to FIG. 2, the branch borehole 7 is provided with tubular wellbore casing 22 cemented in the branch borehole by a layer of cement 24. A valve 26 is fixedly arranged in the casing 22 by means of a lock mandrel schematically indicated by reference numeral 28, the valve having a central longitudinal axis 32 which forms an axis of symmetry of the valve. In FIG. 2 the valve 26 is shown in two different modes of operation for the two different sides relative to the axis of symmetry 32. Arrow 30 indicates the direction from the reservoir 16 to the junction 10 (cf. FIG. 1). The valve 26 includes a tubular housing 34 having a fluid inlet 36, fluid outlets 38*a*, 38*b*, and a fluid passage 40 providing fluid communication between the inlet 36 on one hand and the outlets 38*a*, 38*b* on the other hand. The fluid inlet 36 and the fluid outlets 38*a*, 38*b* are arranged such that fluid flowing through the borehole 7 in the direction of arrow 30 flows via the inlet 36 and the fluid passage 40 to the outlets 38*a*, 38*b*. The housing 34 is provided with an annular valve seat 42 extending around the fluid passage 40, and a closure member 44 movable relative to the housing 34 in longitudinal direction thereof between an open position (indicated at the upper side of axis 32) in which the closure member is remote from the valve seat 42, and a closed position (indicated at the lower side of axis 32) in which an end surface 46 of the closure member 44 contacts the valve seat 42. The shape of the end surface 46 matches the shape of the valve seat 42 so that the fluid passage is closed when the closure member is in the closed position. A compression spring 48 is at one end thereof biased against the closure member 44 and at the other end thereof against an adjustable stop ring 50 arranged in the housing 34, the spring 48 exerting a force F to the closure member 44 when the latter is in the closed position.

The closure member 44 is provided with a central bore 52 having an internal shoulder 54 defining a transition between a larger diameter part 52*a* and a smaller diameter part 52*b* of the bore 52, the larger diameter part 52*a* being closer to the valve seat 42 than the smaller diameter part 52*b*. The larger diameter part 52*a* of the bore 52 is provided with a plug 56 removable from the bore 52 in the direction of the fluid passage 40 by application of a selected fluid backpressure in the smaller diameter part 52*b* relative to a fluid pressure in the fluid passage 40 when the closure member is in the closed position.

The main borehole 5 (FIG. 1) is provided with a valve 60 arranged between the reservoir 18 and the wellbore junction 12, and the branch borehole 9 is provided with a valve 62 arranged between the reservoir 20 and the junction 12. The valves 60, 62 are similar to the valve 26.

During normal operation hydrocarbon fluid, for example natural gas, is to be produced a) from reservoir 20 only, b)

from reservoirs 20 and 18 simultaneously, or c) from reservoirs 20, 18 and 16 simultaneously. Before start of production the fluid pressure $P_0$ in the upper part of the main wellbore is at a level so that the pressure differences across the valves 26, 60, 62 is such that the closure members 44 of the respective valves 26, 60, 62 are in their closed position. When it is desired to produce gas from reservoir 20 only (option a), the pressure $P_0$ in the upper part of the main borehole 5 is gradually lowered by opening production control valve 15 until the pressure difference ($P_1$–$P_0$) across the valve 62 exceeds the spring force F, whereupon the valve 62 moves to the open position and fluid is produced from reservoir 20 through the production facility 14.

When thereafter it is desired to produce gas from reservoirs 20 and 18 simultaneously (option b), the pressure $P_0$ in the upper part of the main borehole 5 is gradually further lowered by further opening production control valve 15 until the pressure difference ($P_2$–$P_0$) across the valve 60 exceeds the spring force F, whereupon the valve 60 moves to the open position and gas is produced from reservoirs 18 and 20 to the production facility 14.

When in a next phase it is desired to produce gas from reservoirs 16, 18 and 20 simultaneously (option c), the pressure $P_0$ in the upper part of the main borehole 5 is gradually even further lowered by even further opening production control valve 15 further until the pressure difference ($P_3$–$P_0$) across the valve 26 exceeds the spring force F, whereupon the valve 26 moves to the open position and gas is produced from reservoirs 16, 18 and 20 to the production facility 14.

In case fluid is to be transferred from surface into one or more of the branch boreholes 7, 9 or the lower part of the main borehole 5, said fluid back-pressure is applied at the downstream side of the respective valve(s) 26, 60, 62 thereby removing the plug(s) 56 from the bore(s) 52 so that fluid can be transferred through the bore(s) 52 in the direction opposite the direction 30.

Furthermore the valves 26, 60, 62 prevent flow of fluid from one reservoir into another since the valves 26, 60, 62 prevent fluid flow in the direction opposite to the direction 30.

Production of fluid in an order different than the order a), b), c) described above can be achieved by adapting the spring forces F of the springs 48 of the respective valves 26, 60, 62 accordingly.

What is claimed is:

1. A flow valve for use in a wellbore system, comprising at least one borehole formed in the earth formation, the borehole being provided with:

(a) a valve body having a passage therein for fluid flow from an upstream side of the valve to a downstream side of the valve;

(b) a closure member mounted in said valve body passage, said closure member having an open position and a closed position;

(c) a spring biasing said closure member to its closed position against a force exerted by a fluid flow on the upstream side of the valve, whereby said closure member is moved to its open position by the application of a reduced pressure in the borehole on the downstream side of the valve, the force exerted by the fluid flow thereafter being sufficient to overcome the force exerted by said spring and maintain the closure member in its open position.

2. The wellbore system of claim 1, wherein the valve is oriented in the borehole in a manner that the closure member is biased to the open position thereof by the force exerted on the closure member by the fluid flow in a direction downstream of said valve.

3. The wellbore system of claim 2, wherein said borehole is one of a plurality of boreholes arranged to produce hydrocarbon fluid from the earth formation to a common hydrocarbon fluid production facility.

4. The wellbore system of claim 3, comprising a plurality of said valves, each valve being arranged in a corresponding one of said boreholes.

5. The wellbore system of claim 4, wherein the spring forces of the springs of the valves are mutually different.

6. The wellbore system of claim 5, wherein the common hydrocarbon production facility is provided with valve means for controlling hydrocarbon fluid flow rate produced from each of said boreholes.

* * * * *